United States Patent [19]

Schleicher

[11] Patent Number: 4,616,892

[45] Date of Patent: Oct. 14, 1986

[54] PLASTIC DRAWER

[75] Inventor: Siegfried Schleicher, Eferding, Austria

[73] Assignee: Ernst Stadelmann Gesellschaft m.b.H., Eferding, Austria

[21] Appl. No.: 705,990

[22] Filed: Feb. 27, 1985

[30] Foreign Application Priority Data

May 7, 1984 [EP] European Pat. Off. ..... 84890080.9

[51] Int. Cl.[4] ..... A47B 88/00

[52] U.S. Cl. ..... 312/330 R; 211/184; 312/183

[58] Field of Search ..... 211/184; 108/61; 312/183, 184, 330 R; 220/22.2, 22.3, 22, 71

[56] References Cited

U.S. PATENT DOCUMENTS 524,163 8/1894 Coleman ..... 211/184 X
903,769 11/1908 Pondexter ..... 211/184
4,133,590 1/1979 Young ..... 312/184 X
4,517,231 5/1985 May et al. ..... 220/22 X

FOREIGN PATENT DOCUMENTS 301787 9/1972 Austria .
G8127807.1 2/1982 Fed. Rep. of Germany .

*Primary Examiner*—James T. McCall
*Attorney, Agent, or Firm*—Karl F. Ross; Herbert Dubno

[57] ABSTRACT

A plastic drawer comprises a bottom, longitudinal side walls, and a transverse partition detachably connected to the longtitudinal side walls. To preclude a deformation of the side walls and of the bottom, the transverse partition is firmly connected to the bottom of the drawing. That connection may be effected by means of a vertical carrying pin, which is rotatably supported in the transverse partition and extends through an opening formed in the bottom and is rotatable to a position in which a locking member carried by the carrying pin engages the underside of the bottom of the drawer.

11 Claims, 2 Drawing Figures

PLASTIC DRAWER

BACKGROUND OF THE INVENTION

1. Field of the Invention

This invention relates to a plastic drawer having a transverse partition detachably connected to and supported by two longitudinal side walls.

2. Description of the Prior Art

Drawers and compartments for office furniture mainly intended to accommodate card files, trays or partitions must have a high strength and should be fully operative even under extremely high loads. These requirements can be met only with difficulty if such furniture elements are made of plastics, such as modified polystyrene, because the required stiffness and fracture strength cannot be ensured by a relatively small wall thickness alone so that special structural designs must be adopted mainly to prevent a deflection of the side walls and of the bottom. An inward deflection of the side walls under a certain load will be detrimental to the guidance of the drawer and may substantially obstruct the handling of various items contained in the drawer. A substantial deflection of the bottom under load may render the drawer inoperative because the downwardly deflected bottom of a drawer which is being moved may wipe on the contents of the next lower drawer and may push part of said contents along or may cause the drawer to be seized. If the deflection under load persists for a certain time, the plastic having a low restoring force will exhibit a cold flow so that the drawer will be permanently deformed.

In order to avoid such difficulties, it is known to provide such drawers with stiffening ribs or bars, mainly on the side walls. In some cases these ribs or bars are merely reinforcements but in other cases they also assist the guidance of the drawer (Austrian Patent Specification No. 301,787). It is also known to provide the longitudinal side walls of drawers with reinforcing and guiding metal rails (Austrian Patent Specification No. 319,518) and to increase the strength of the drawer by the provision of double side walls (German Utility Models Nos. 81 27 807 and 79 31 270). But all previous proposals outlined hereinbefore are concerned only with the stiffening of the side walls or with the stiffening of said side walls and the guidance of the drawer. On the other hand, the known measures outlined hereinbefore do not result in a substantial improvement of the strength of the bottom of the drawer and any ribs which have been provided on the bottom can have only restricted dimensions so that they are entirely inadequate.

SUMMARY OF THE INVENTION

It is an object of the invention to eliminate the disadvantages outlined hereinbefore and to provide a drawer or other furniture element which is of the kind described first hereinbefore and which involves a relatively low structural and manufacturing expenditure and will meet very high requirements regarding strength and load-carrying capacity.

This object is accomplished in accordance with the invention in that the transverse partition is connected to the bottom of the drawer at least at one point by tension-resistant means resisting a separation of the bottom from the partition. As a result, the bottom of the drawer is virtually suspended from the transverse partition, which is connected to the longitudinal side walls of the drawer so that the transverse partition is secured to the longitudinal side walls at least at two points and to the bottom at least at one point and a very high stability will thus be ensured and a temporary or permanent deformation of the bottom of the drawer and of its side walls will be precluded. In most cases it will be sufficient to connect the bottom of the drawer to the transverse partition in the middle of its length. Alternatively, the transverse partition may be connected to the bottom at two or more spaced apart points if this is required.

A structurally simple and easily operable drawer will be obtained if the transverse partition is connected to the bottom of the drawer by a carrying pin, which is rotatably mounted in the transverse partition and extends through an anchoring opening in the bottom and is rotatable to a position in which a locking portion of the carrying pin engages the bottom on its underside. That locking portion may preferably have the shape of a hammer head and the bottom of the drawer may be formed with an anchoring slot through which said locking portion can be moved. By a rotation of the carrying pin, the transverse partition can be connected to the bottom of the drawer in such a manner that desirable loading conditions will be obtained. Because the carrying pin can be rotated between locking and unlocking positions by a single manipulation, the transverse partition can be fitted into the drawer or can be replaced or can be moved to a different position in the drawer quickly and without substantial difficulty.

Within the scope of the invention the bottom of the drawer may be provided on the underside near the anchoring opening with edge ribs formed with ramp and backing surfaces and/or latching recesses for engagement by the locking portion. In that case the bottom and the partition can be forced against each other as they are interlocked so that the strength of the joint will be increased. Any latching recesses which are provided will prevent an unintended unlocking.

In a preferred embodiment of the invention the transverse partition is double-walled and open-bottomed, the carrying pin is accommodated in said transverse partition in a chamber that is defined by vertical stiffening ribs, and the carrying pin extends through an opening provided at the top of the transverse partition and at its top end carries a knob supported by the transverse partition, which in the lower portion of said chamber contains a centering element through which the carrying pin extends. The double-walled transverse partition inherently has a high strength and permits a suitable mounting of the carrying pin so as to provide a pleasing appearance and to avoid a disturbance. The carrying pin can easily be rotated by means of the knob. The centering element will facilitate the insertion of the locking portion of the carrying pin into the opening formed in the bottom of the drawer and permits an uncomplicated design of the transverse partition.

Within the scope of the invention each of the preferably double-walled longitudinal side walls of the drawer may be provided in its top edge with a series of longitudinally spaced apart openings for selectively receiving depending hook portions of the transverse partition, and the bottom of the drawer may be formed with a series of longitudinally spaced apart anchoring openings associated with respective parts of transversely aligned openings in the top edges of the longitudinal side walls. In that case the transverse partition may be connected to the bottom in any of a plurality of positions and the positions which can be selected for the transverse partition will not be restricted by the requirement to connect the transverse partition to the bottom.

The bottom of the drawer may be provided on its underside with two longitudinal ribs disposed on opposite sides of the series of anchoring openings, and with transverse ribs, which connect said longitudinal ribs and each of which extends between two adjacent anchoring openings. Such an arrangement will additionally stiffen the bottom adjacent to the anchoring openings and the longitudinal and transverse ribs will define compartments in which the locking portion can be accommodated and protected.

DETAILED DESCRIPTION OF THE PREFERRED EMBODIMENT

Figure 1:
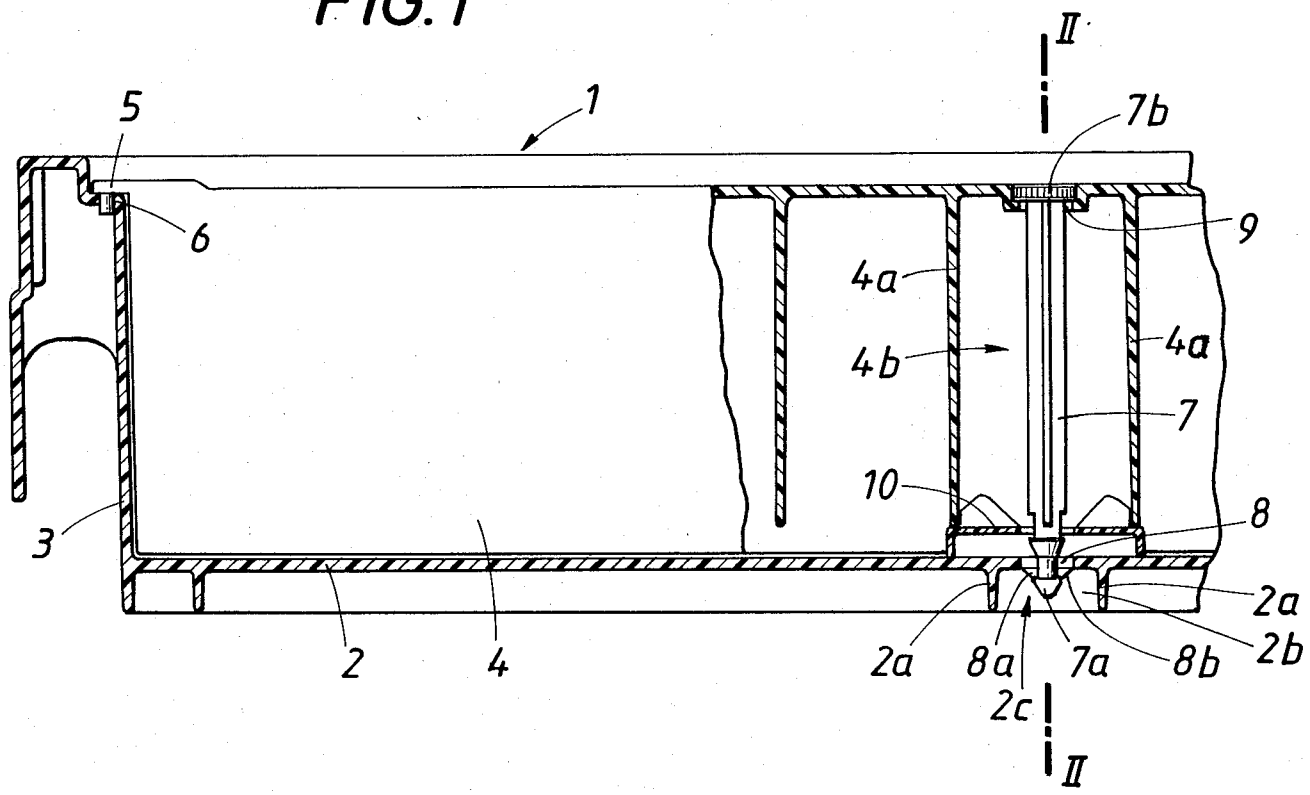
FIG. 1 is a transverse sectional element showing a drawer which embodies the invention.
Figure 2:
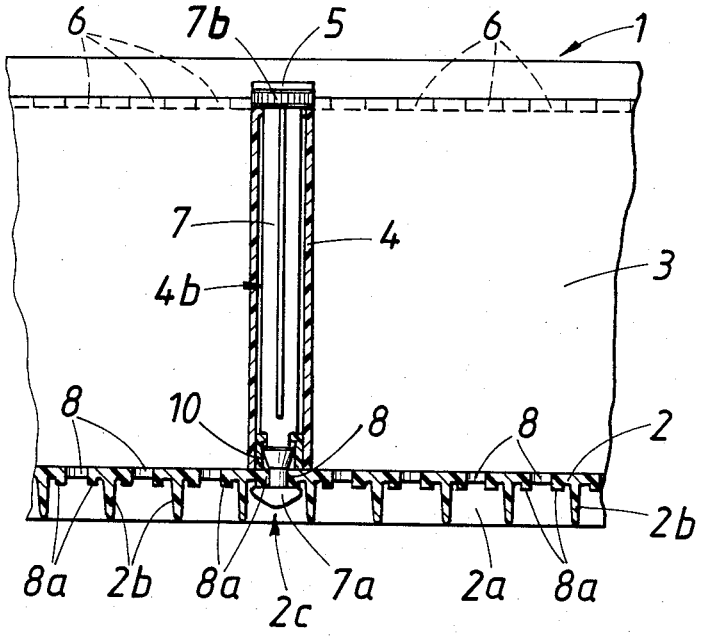
FIG. 2 is a sectional view taken on line II—II in FIG. 1.

An illustrative embodiment of the invention is diagrammatically shown on the drawing.

A plastic drawer 1 comprises a bottom 2, double-walled longitudinal side walls 3 and a double-walled vertical transverse partition 4. The partition 4 is provided near its top with depending hook portions 5, each of which is detachably inserted in one of a plurality of longitudinally spaced apart, open-topped openings 6 formed in the top edge of each longitudinal side wall 3. In order to reliably prevent a deformation of the bottom 2 and of the longitudinal side walls 3, the bottom 2 is connected to the transverse partition 4 at the center of the length of the latter. For this purpose a carrying pin 7 is rotatably supported by the transverse partition 4 and is provided at its lower end with a hammer head 7*a*, which can be moved through an anchoring slot 8 formed in the bottom 2. When the hammer head 7*a* is disposed under the bottom 2, the carrying pin can be rotated to a position in which the hammer head engages edge ribs 8*a* provided on the underside of the bottom 2 at the edges of the slot 8. These edge ribs 8*a* have ramp surfaces and backing surfaces 8*b* so that the carrying pin 7 can force the transverse partition 4 and the bottom 2 toward each other. The transverse partition 4 is hollow and open-bottomed and accommodates the carrying pin 7 in a chamber 4*b*, which is defined by stiffening ribs 4*a*. The carrying pin 7 is provided at its upper end with a knob 7*b*, which bears on the transverse partition around an opening 9, through which the carrying pin 7 extends. The carrying pin 7 extends also through a centering element 10 disposed in the lower portion of the chamber 4*b*. That centering element 10 facilitates the introduction of the hammer head 7*a* of the carrying pin 7 into the slot 8.

When the hook portions 5 of the transverse partition 4 have been inserted into respective openings 6 at the top of the longitudinal side walls 3 and the carrying pin 7 has been rotated to lock the bottom 2 to the transverse partition 4, the transverse partition will be connected to both longitudinal side walls 3 at their top edges and to the bottom 2 in the middle of the length of the transverse partition 4 so that the drawer will then have a high stiffness. No deformation of the side walls 3 and of the bottom 2 needs to be feared even under high loads. Specifically, a downward deflection of the bottom 2 is precluded.

In order to avoid an unnecessary restriction of the positions in which the transverse partition 4 can be installed, each longitudinal side wall 3 is provided with a series of longitudinally spaced apart openings 6 and the bottom 2 is formed with a plurality of longitudinally spaced apart slots 8. The bottom 2 is provided on its underside with two longitudinal ribs 2*a* extending on opposite sides of the series of slots 8, and with transverse ribs 2*b*, which connect the longitudinal ribs 2*b* and each of which extends between two adjacent slots 8. As a result, a compartment 2*c* for accommodating the hammer head 7*a* is provided adjacent to each slot 8 and the hammer head 7*a* does not project downwardly in a disturbing manner.

I claim:

1. In a plastic drawer comprising a bottom, two longitudinal side walls and at least one vertical transverse partition detachably connected to and supported by said side walls, the improvement residing in the provision of tension-resisting anchoring means connecting said bottom at said transverse partition and resisting a separation of said bottom from said partition, said means having a locking portion disposed under said bottom.

2. The improvement set forth in claim 1, wherein said bottom is formed with an anchoring opening, said anchoring means comprise a vertical carrying pin, which is rotatably supported in and protrudes downwardly from said transverse partition and through said opening and is provided at its lower end with said locking portion disposed under said bottom, and said carrying pin is rotatable to a position in which said locking portion engages the underside of said bottom.

3. The improvement set forth in claim 2, wherein said anchoring opening consists of a slot and said locking portion consists of a hammer head which is movable through said slot.

4. The improvement set forth in claim 2, wherein said bottom is provided on its underside adjacent to said anchoring opening with ribs having ramp and backing surfaces which are engageable by said locking portion.

5. The improvement set forth in claim 2, wherein said bottom is provided on its underside adjacent to said openings with ribs which are engageable by said locking portion and having latching openings adapted to receive said locking portion.

6. The improvement set forth in claim 2, wherein said transverse partition is double-walled and open-bottomed and is formed with vertical internal ribs defining a chamber in the interior of said transverse partition and is formed at its top with an opening, a centering element is carried by said transverse partition and disposed in said chamber and said carrying pin extends through said opening at the top of said transverse partition and through said centering element and carries a knob disposed above and supported by said transverse position.

7. The improvement set forth in claim 1 as applied to a drawer in which said side walls are provided with a plurality of longitudinally spaced apart connecting means for detachably connecting said transverse partition to said side walls in a plurality of longitudinally spaced apart positions, wherein said bottom is provided with a plurality of longitudinally spaced apart means for cooperating with said anchoring means when said transverse partition is in any of said longitudinally spaced apart positions.

8. The improvement set forth in claim 7, wherein said transverse partition is provided at opposite ends near its top with depending hook portions, each of said longitudinal side walls is provided at its top with a plurality of longitudinally spaced apart, open-topped openings, each of which is adapted to receive one of said hook portions and said bottom is formed with a series of longitudinally spaced apart anchoring openings for cooperation with said anchoring means.

9. The improvement set forth in claim 8, wherein said longitudinal side walls are double-walled.

10. The improvement set forth in claim 8, wherein said bottom is provided on its underside with two longitudinal ribs extending on opposite sides of said series of anchoring openings and with a plurality of longitudinally spaced apart transverse ribs, each of which extends between two of said anchoring openings.

11. In office furniture comprising a compartment-defining plastic structure including a bottom, two longitudinal side walls and at least one vertical transverse partition detachably connected to and supported by said side walls, the improvement residing in the provision of tension-resisting anchoring means connecting said bottom at said transverse partition and resisting a separation of said bottom from said partition.

* * * * *